United States Patent [19]

Schmitz

[11] Patent Number: 4,543,769

[45] Date of Patent: Oct. 1, 1985

[54] METHOD AND APPARATUS FOR FORMING AND WRAPPING OBJECTS OF A SOFT MASS

[75] Inventor: Heinz Schmitz, Hürth-Efferen, Fed. Rep. of Germany

[73] Assignee: Rose Verpackungsmaschinenfabrik Theegarten, Cologne, Fed. Rep. of Germany

[21] Appl. No.: 355,721

[22] PCT Filed: Jul. 3, 1981

[86] PCT No.: PCT/DE81/00107

§ 371 Date: Mar. 1, 1982

§ 102(e) Date: Mar. 1, 1982

[87] PCT Pub. No.: WO82/00082

PCT Pub. Date: Jan. 21, 1982

[30] Foreign Application Priority Data

Jul. 5, 1980 [DE] Fed. Rep. of Germany ..... 3025507

[51] Int. Cl.[4] ..... B65B 9/12

[52] U.S. Cl. ..... 53/450; 53/140; 53/548; 426/5; 426/284; 426/518

[58] Field of Search ..... 53/454, 450, 459, 439, 53/469, 140, 113, 567, 548, 550, 480; 426/284, 5, 512, 518; 99/450.1, 450.4; 425/395, 441

[56] References Cited

U.S. PATENT DOCUMENTS

| | | | |
|---|---|---|---|
| 1,318,292 | 10/1919 | Laskey | 426/284 |
| 2,575,138 | 11/1951 | Slaughter | 53/140 X |
| 2,744,370 | 5/1956 | Seragnoli | 53/227 X |
| 2,764,862 | 10/1956 | Rado | 53/373 |
| 2,958,169 | 11/1960 | Flax | 53/469 |
| 3,269,088 | 8/1966 | Kath | 53/560 |
| 3,740,300 | 6/1973 | Heinzer | 53/548 X |
| 3,857,963 | 12/1974 | Graff et al. | 426/5 |
| 4,015,021 | 3/1977 | Harima et al. | 53/450 X |
| 4,262,473 | 4/1981 | Brooke | 53/450 |
| 4,363,205 | 12/1982 | Hollander, Jr. | 53/469 X |

FOREIGN PATENT DOCUMENTS

| | | | |
|---|---|---|---|
| 1119750 | 12/1961 | Fed. Rep. of Germany | 53/561 |

*Primary Examiner*—Horace M. Culver

*Attorney, Agent, or Firm*—Body, Vickers & Daniels

[57] ABSTRACT

Method and apparatus for forming and wrapping objects of a soft mass in which a hollow rope of material (11) filled with a liquid (10) is divided into individual pieces ($B_1$ and $B_2$) between cutter shoes (20 and 21) moving against each other in that one piece ($B_1$) after the other ($B_2$) is simultaneously squeezed by squeezing strips (26 and 27) at its rear end (in feed direction) and separated at its front end (in feed direction) from the preceding piece ($B_1$) which is subsequently pushed at a right angle to the feed direction (15) of the rope of material (11) into a wrapping station.

10 Claims, 3 Drawing Figures

METHOD AND APPARATUS FOR FORMING AND WRAPPING OBJECTS OF A SOFT MASS

FIELD OF THE INVENTION

The invention is concerned with a method and apparatus for forming objects of a soft mass, particularly filled candies, chewing gum or the like, in which the rope of material, possibly provided with a soft or liquid filling, is subdivided by squeezing into a first still cohesive chain of objects which are subsequently completely separated.

DESCRIPTION OF THE PRIOR ART

In the forming and wrapping of candies the individual pieces are formed first from a rope of material prior to being molded and subsequently wrapped. In case of objects filled with a liquid or soft filling the difficulty arises that the liquid filling escapes in the cutting operation. It is therefore known to squeeze the rope of material at two consecutive subsequent cutting points to such an extent that the walls of the cover opposite each other are lying on top of each other and the liquid filling is enclosed in the cover between these two compressed spots. Such a method and an apparatus suitable for it has for instance become known from the German Pat. No. 11 96 056.

In this known apparatus the rope of material is tangentially fed to an embossing wheel which has on its circumference several consecutive chambers which are bounded by axially oriented squeezing strips, movable against each other to compress the rope of material in spots and form it into a continuous chain of filled candy pieces. The pieces present between the squeezing strips are then axially pressed into the mold openings arranged in the molding wheel, in which operation the bridges remaining between the pieces are torn off. The subsequently ejected candies arrive then at random on a discharge conveyor, where they have first to be rearranged before they can be transported one after the other to a wrapping machine.

When the candies, still cohering in a chain, are inserted into the mold openings, the danger exists that the compressed seams between the surfaces of the cover lying upon each other tear or open and the liquid filling can totally or partially escape, which is undesirable and leads to dirtying of the machinery which hereby becomes quickly incapable of functioning properly and has to cleaned. It is moreover difficult to rearrange the candies arriving at random on the discharge conveyor before they can be fed over more or less long paths to the wrapping machine which wraps the individual candies.

BRIEF SUMMARY OF THE INVENTION

It is the task of the invention to provide a very simple method and a robust, very fast working apparatus of the kind explained in detail at the beginning with which can be produced objects of a soft mass, particularly such objects provided with a soft or liquid filling, which immediately upon being separated can be immediately packed, i.e. wrapped one after the other. In such an arrangement a particularly simple transportation by the molding and separating machine is necessary. The construction has to be of such a nature that a liquid or pasty filling in the soft rope of material cannot escape while it is separated or after it has been cut into individual pieces.

This problem is solved according to the invention by a method in which one piece after the other is simultaneously squeezed at its rear end (in feed direction) and separated at its front end (in feed direction) from the preceding piece, which cut-off piece is subsequently pushed transversely to the feed direction of the rope of material directly into a wrapping station.

This construction has the advantage that a substantially higher traveling speed is made possible than by the known methods, since the rope of material formed into chain is transported for the severing operation in the same direction and does not go through a reversal of direction until each piece to be wrapped has been separated from the rope.

Each piece is formed in a single operation with a constriction and a cut, in which setup the cutting always takes place at an already constricted spot, but proceeds in the same direction as the squeezing procedure.

The object can be molded while its ends are squeezed and severed. In this operation it is important that the molding of the pieces is not laterally interfered with by the squeezing and the separation. The rope of material can be fed to the squeezing-, separating- and possibly the molding-station by steps. It is also possible to squeeze, separate and possibly mold the individual pieces on the continuously advanced rope of material.

The apparatus for molding objects of a soft mass, particularly filled candies, chewing gum or the like, includes squeezing strips movable against each other between which the rope of material is constricted and subdivided into a chain of pieces still connected with each other by small bridges which are separated from each other and fed into a wrapping machine is characterized in that the squeezing strips are mounted on cutter shoes, movable against each other, which carry cutting blades which are arranged in longitudinal direction of the rope of material at a distance from the squeezing strips corresponding to the length of the individual objects and about parallel to them and that in the feed direction of the rope of material behind the cutting blades a wrapping device for the individual pieces is set up.

With such an apparatus it is possible to divide the individual candy or chewing gum pieces very gently at one end and to cut them off at the same time at the other end. In this setup a liquid filling cannot escape the rope of material when the cross section is narrowed down in the squeezing operation. Since such a narrowing-down of the cross section of the piece to be cut off takes place only on one side, the volume reduction is here smaller than in the case of the simultaneous constriction of both ends, as it is carried out in the known stamping wheels. Moreover the operating speed of the wrapping device can be adapted to the traveling speed of the candies in the molding and separating operation.

According to the invention suitably arranged in the area of the cutter shoes is a supporting rail for the rope of material which has at least one clearance for letting the squeezing strips pass through. In feed direction can be provided behind the cutter shoes a guide rail which extends at a right angle to the feed direction in the direction toward the packing head of the wrapping machine. The cut-off pieces are then one after the other pushed into the packing head of the wrapping machine, where they are wrapped one after the other.

The one of the two cutter shoes movable against each other can have a first mold face, arranged between squeezing strip and cutting blade, which cooperates with the front part of the supporting rail bounded by the squeezing strip and the cutting blade of the other cutting shoe, forming a second mold face. This construction offers the advantage that the pieces are molded simultaneously while being constricted and cut off.

According to a further characteristic of the invention each cutter shoe can have several squeezing strips equally spaced from each other whose height always increases on at least one cutter shoe from one squeezing strip to the other in the direction toward the cutting blades. This construction has the advantage that the points of separation between the individual pieces or objects into which the rope of material is subdivided are gradually molded in. This is particularly important in subdividing ropes of material filled with liquids or pastes in order to prevent that the jacket filled with liquid is torn while being squeezed.

The cutter shoes are capable of being advanced in the feed direction of the rope of material and retracted and serve at the same time as feeding device for the rope of material or the chain of pieces made of it, respectively. In another form feed rolls and/or calibrating rolls are installed ahead of the cutter shoes for the advancing and/or molding the rope of material.

In another form the feeding and/or calibrating rolls carry notching strips, projecting beyond their circumference and about parallel to the axis of rotation of the rolls, which are arranged in circumferential direction of the rolls spaced according to the length of the pieces and prenotch the rope of material. It is suitable in such an arrangement that the walls of a filled rope of material are compressed only to such an extent that the walls do not touch each other in the notched places, so that at the notched point a gap remains into which can flow back the liquid filling counter to the feed direction.

The notching strips are suitably adjustable in circumferential direction of the rolls in order that the spacing of the notched spots coincides exactly with the length of the piece cut off by the cutter shoe.

BRIEF DESCRIPTION OF THE DRAWINGS

Further characteristics and advantages of this invention issue from the following description and the drawings in which a preferred form of execution is described in detail. It is shown in FIG. 1 an apparatus for molding candies filled with a liquid according to the invention in a partial schematic representation in longitudinal section, FIG. 2 the lower cutter shoe in another embodiment of the invention in longitudinal section and FIG. 3 another embodiment of the invention in a reprsentation corresponding to the FIG. 1.

DETAILED DESCRIPTION OF THE INVENTION

Figure 1:
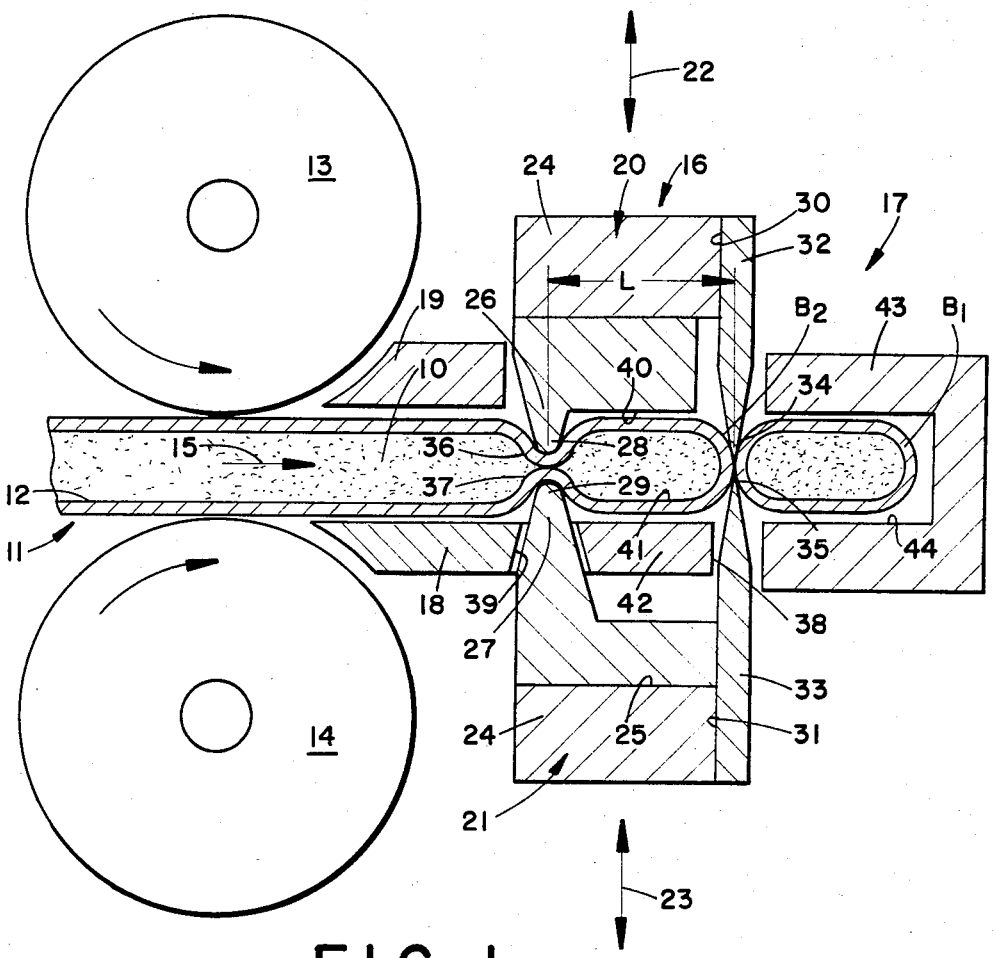

A tubular rope of material 11 provided with a liquid filling 10 enclosed by a sugar coat 12 in the way of a hose. The rope 11 is advanced by two counterrotating feeding rolls 13 and 14, indicated only in FIG. 1 along a longitudinal path, in the direction 15 into a combined constricting-, separating- and molding-station 16 and subsequently fed into a wrapping station 17. The feeding rolls 13 and 14, to which can be assigned two additional, laterally arranged molding rollers which are, however, not shown in the drawing, advance the rope of material 11 step by step between a lower supporting rail 18 and an upper detaching rail 19 a longitudinal distance corresponding to the length L of a candy B into the constricting and separating station 16 which is, however, not exhibited in its entirety in more detail.

In the constricting and separating station two cutter shoes 20 and 21 are reciprocated toward each other and away from each other in sequence with the advancement of the rope of material 11 in the direction of the arrows 22 and 23 respectively by a drive mechanism not shown here in any detail. Each cutter shoe has a carrier 24 on whose surface 25 facing the rope of material 11 is mounted a squeezing strip 26 and 27 respectively. The squeezing strips 26 and 27 extend crosswise to the feed direction 15 and have tapered but blunt edges 28 and 29 which are opposing each other.

On the front sides 30 and 31 of the cutter shoes 20 and 21 away from the feed rolls 13 and 14 are mounted cutting blades 32 and 33 which lie in the same plane and whose cutting edges 34 and 35 respectively are directed against each other. In this arrangement the blades 32 and 33 are arranged in relation to each other in such a way that their cutting edges 34 and 35 touch each other when the edges 28 and 29 are still at a distance from each other which is slightly smaller than the walls 36 and 37 of the coat 12 of the rope of material 11 compressed by the edges 28 and 29. The supporting rail 18 has at a distance from the front edge 38 a clearance 39 which is adapted in its size to the squeezing strip 27 of the lower cutter shoe 21 and through which can enter the squeezing strip 27 into the path of travel of the rope of material 11. The upper cutter shoe 20 has on its bottom side between the squeezing strip 26 and the cutting blade 32 a molding face 40 which cooperates with the front part 42 of the supporting rail 18 to form a second mold face 41 bounded by the squeezing strip 27 and the cutting blade 33 of the other cutter shoe 21. These mold faces can for instance be corrugated or, depending on the desired shape of the candy, also have a bulge.

In the feed direction 15 behind the cutter shoes 20 and 21 is a guide rail 43 of a U-shaped cross section whose guide channel 44 is adapted in its height and width to the longitudinal section of the candies B which have been cut off from the rope material 11 in the constricting and separating device 16. The guide rail 43 extends transversely to the feed direction 15 in the direction toward a packing head of the wrapping machine not shown here in any detail which is suitably arranged immediately next to the constricting and separating station 16. A push rod working vertically to the drawing plane transversely shifts one candy B after the other into the packing head, where it is wrapped and then carried away.

OPERATION OF THE INVENTION

The rope of material 11 is advanced by the feed rolls 13 and 14 in the direction of the arrow 15 between the separated cutter shoes 20 and 21 by the length L and then arrested. Thereupon the cutter shoes 20 and 21 move toward each other until they occupy the position shown in FIG. 1. In so doing the edges 28 and 29 of the squeezing strips 26 and 27 the walls 36 and 37 of the jacket 12 of the rope of material firmly, while at the same time the knives 32 and 33 sever and separate the candy $B_1$, previously formed and pushed into the channel 44 of the guide rail 43 by the following candy $B_2$ present between the mold faces 40 and 41 of the cutter shoes 20 and 21.

The cutter shoes 20 and 21 are then again pulled apart in the direction of the arrows 22 and 23, while simultaneously a push rod pushes the candy $B_1$ in the guide rail 43 perpendicularly to the drawing plane to the packing head of the wrapping machine and again returns it, so that the space in the channel 44 opposite the outlet of the constricting and separating device becomes again vacant. The feed rolls 13 and 14 advance the rope of material 11 again by the length L. The candy $B_1$ enters hereby into the guide rail 43. Subsequently the cutter shoes 20 and 21 move again toward each other, whereby the walls 36 and 37 are again squeezed together by the edges 28 and 29 and the candy $B_2$ is again cut off from the following candy $B_3$ by the knives 32 and 33. This operation is then repeated in quick succession, so that one candy after the other is formed and wrapped.

In place of the intermittent advance the rope of material 11 can also be coninuously fed. In this case the cutter shoes 20 and 21 are provided with a supplementary drive which lets them rapidly move in the feed direction 15 and in the opposite direction, so that the candies are squeezed and separated while being advanced.

Figure 2:
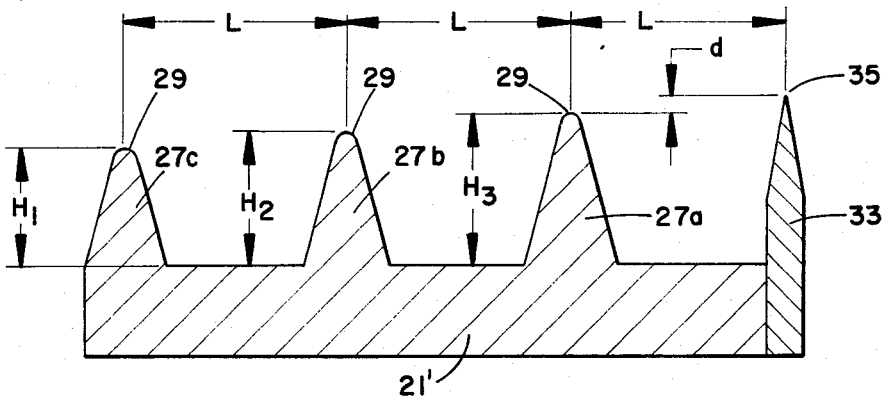

In FIG. 2 is shown a variant of the cutter shoes of which, however, only the lower one is exhibited.

One recognizes that the cutter shoe 21' exhibited in FIG. 2 has several squeezing strips 27*a*, 27*b* and 27*c*, spaced from each other by an equal distance L, whose height $H_1$, $H_2$ and $H_3$, respectively, increases from one squeezing strip 27*c* or 27*b*, respectively, to the other squeezing strip 27*b* or 27*a*, respectively, in the direction toward the cutting blade 33. In this setup is the height $H_3$ of the squeezing strip 27*a*, lying closest to the cutting blade 33, arranged by the measure d deeper than the cutting edge of the knife 35, in which arrangement the measure d is slightly smaller than the diameter of the jacket 12 of the rope of material 11.

If for the apparatus according to FIG. 1 cutter shoes of the kind exhibited in FIG. 2 are used, the supporting rail 18 has of course to be longer toward the front and it has to be provided with three clearances for letting the sqeezing strips 27*a* to 27*c* pass through. With the cutter shoes 21' moving toward each other three candies are then simultaneously preformed; this, however, in such a way that on the candy farthest away from the cutting blades 32 and 33 the jacket walls are only slightly compressed by the sqeezing strips 27*c* since the edges 29*c* of this squeezing strip 27*c* farthest back are located at a relatively great distance of about six d when the cutting edges 34 and 35 of the knives 32 and 33 touch each other. When then in the next operation the cutter shoes 21' are retracted and the rope of material 11 is further advanced by the length L, the edges 29*b* of the follwing squeezing strip 27*b* squeeze the walls of the jacket 12 even more, but not so far that they are firmly compressed. The liquid filling present in the preformed candy can for this reason flow counter to the feed direction 15 farther toward the back, so that one does not have to be afraid that the carefully compressed candy may burst at its edges.

Figure 3:
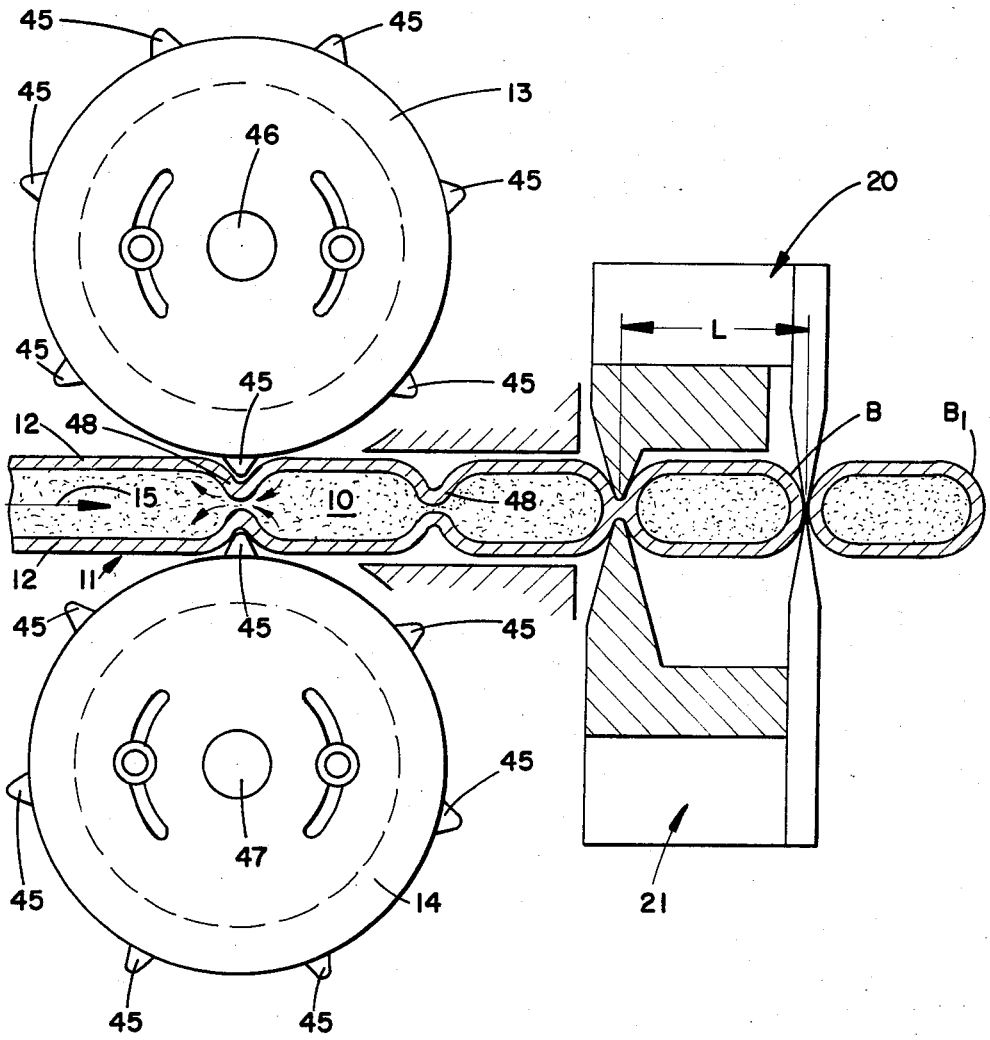

In FIG. 3 is shown a further form of execution of the invention which corresponds essentiallly to the form of execution exhibited in FIG. 1, in which, however, the feeding and calibrating rolls 13 and 14 carry several notching strips 45 which project beyond the circumference of the rolls 13 and 14 and extend about parallel to the axes of rotation 46 and 47 of the rolls 13 and 14. The rolls 13 and 14 with their notching strips 45 are adjustable in circumferential direction on the axles 46 and 47, respectively, in order to make it possible to adjust the feed drive and the spots for the prenotching on the rope of material 11 to the length of the distance L of the cutting blades 32 and 33 and of the squeezing strips 26 and 27 as well as to the feeding sequence of the cutter shoes 20 and 21. For the same purpose the axles 46 and 47 of the feed rolls 13 and 14 can also be adjustable in the feed direction 15 of the rope of material.

One recognizes that the rope of material 11 notched by two notching strips 45 of the feed rolls 13 and 14 opposite each other only to such an extent that the walls 12 of the hollow rope of material 11 filled with a liquid 10 do not make contact on their interior surfaces, but that a gap 48 remains between them through which the liquid 10 can flow from the preformed candy toward the rear counter to the feed direction 15.

The invention is not limited to the examples of execution. It is for instance also possible to arrange several cutter shoes on the circumference of molding wheels rolling one upon the other to which the rope of material is axially supplied and from which the candies are axially drawn off. The cutter shoes and the wrapping units can also be arranged in a different way without leaving the scope of the invention.

I claim:

1. A method for forming filled candy and chewing gum having a soft outer peripheral coating and a softer encapsulated interior filling comprising the steps of:

(a) feeding an elongated tubular member having a generally cylindrical outer sleeve corresponding to the coating and containing the interior filling, along a longitudinal path;

(b) constricting the tubular member at an intermediate portion to engage the inner surfaces thereof at a transverse bridging section thereby longitudinally separating portions of the interior filling and severing the tubular member simultaneously with the constricting at the bridging section immediately succeeding the bridging section formed by said constricting to seal the free end of the tubular member and form individual objects having a continuous outer coating encapsulating an interior filling; and, (c) holding the free end of the tubular member during said severing and shifting the severed individual objects between successive constricting and severing steps in a direction transverse to the longitudinal path without change in longitudinal orientation.

2. The method recited in claim 1 including the step of partially forming said bridging section in the tubular member prior to said constricting to form a longitudinal chain of partially defined objects fed along said longitudinal path to said constricting and severing step.

3. The method recited in claim 1 or 2 including the step of molding the tubular member to a desired shape longitudinally between and simultaneously with the constricting and severing steps.

4. The method recited in claim 1 wherein the feeding is intermittent with a sequential advance equal to the longitudinal length of the individual objects.

5. The method recited in claim 1 wherein the feeding is continuous.

6. An apparatus for forming candy and chewing gum from an elongated member of soft mass having a softer interior filling comprising: advancing means for feeding said elongated member along a longitudinal path; constricting means for sequentially partially compressing intermittent sections of said elongated member to form a chain of partially defined objects interconnected by said intermittent sections; severing means operable concurrently with the constricting member for separating the elongated member at the immediately succeeding intermittent section at a distance from the constricting means corresponding to the final length of said object thereby forming individual objects; holding means adjacent the severing means for receiving the free end portion of the tubular member prior to said separating; and transfer means for transversely shifting the individual objects subsequent to said separating from the longitudinal path without change in longitudinal orientation.

7. The apparatus as recited in claim 6 wherein said advancing means and said constricting means comprise roller members having transverse projections for forming said intermittent sections.

8. The apparatus as recited in claim 7 wherein said transverse projections are circumferentially adjustable on said roller members.

9. The apparatus recited in claim 6 wherein the constricting means are reciprocable along the longitudinal path to function as the advancing means for feeding the elongated member along the longitudinal path.

10. The apparatus as recited in claim 6 wherein said constricting means include supplemental means for progressively compressing said intermittent sections.

* * * * *

UNITED STATES PATENT AND TRADEMARK OFFICE

CERTIFICATE OF CORRECTION

PATENT NO. : 4,543,769

DATED : October 1, 1985

INVENTOR(S) : Heinz Schmitz

It is certified that error appears in the above-identified patent and that said Letters Patent are hereby corrected as shown below:

On the title page;

Delete the present recitation of the assignee and substitute therefor --ROSE Verpackungsmaschinenfabrik Theegarten GmbH & Co. KG--.

Signed and Sealed this

*Twenty-fifth* Day of *March 1986*

[SEAL]

*Attest:*

DONALD J. QUIGG

*Attesting Officer*

*Commissioner of Patents and Trademarks*